US009799288B2

(12) United States Patent
Zhang

(10) Patent No.: US 9,799,288 B2
(45) Date of Patent: Oct. 24, 2017

(54) DRIVING CIRCUIT AND LIQUID CRYSTAL DISPLAY DEVICE

(71) Applicant: Shenzhen China Star Optoelectronics Technology Co., Ltd., Shenzhen, Guangdong (CN)

(72) Inventor: Xianming Zhang, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 112 days.

(21) Appl. No.: 14/902,552

(22) PCT Filed: Sep. 24, 2015

(86) PCT No.: PCT/CN2015/090523

§ 371 (c)(1),
(2) Date: Dec. 31, 2015

(87) PCT Pub. No.: WO2017/041331

PCT Pub. Date: Mar. 16, 2017

(65) Prior Publication Data

US 2017/0236475 A1 Aug. 17, 2017

(30) Foreign Application Priority Data

Sep. 9, 2015 (CN) ..... 2015 1 0570239

(51) Int. Cl.
*G09G 3/36* (2006.01)

(52) U.S. Cl.
CPC ... *G09G 3/3648* (2013.01); *G09G 2310/0213* (2013.01)

(58) Field of Classification Search
CPC ..... G09G 3/3648; G09G 2310/0213
See application file for complete search history.

(56) References Cited

U.S. PATENT DOCUMENTS

2008/0055948 A1* 3/2008 Wu ..... G09G 3/3413 363/84
2011/0037399 A1* 2/2011 Hung ..... H05B 33/0815 315/219
2011/0101880 A1* 5/2011 Ribarich ..... H05B 33/0815 315/250
2013/0141003 A1* 6/2013 Esaki ..... H05B 37/02 315/224
2014/0125238 A1* 5/2014 Kwon ..... H05B 33/0809 315/193
2016/0260384 A1* 9/2016 Kim ..... G09G 3/3648

* cited by examiner

*Primary Examiner* — Ryan A Lubit
(74) *Attorney, Agent, or Firm* — Andrew C. Cheng

(57) ABSTRACT

The present invention discloses a driving circuit and a liquid crystal display device. An anode of a first diode is employed for inputting a voltage, and a cathode of the first diode is coupled to an anode of a second diode, and a cathode of the second diode is coupled to an anode of a third diode, and a cathode of the third diode is coupled to an anode of a fourth diode, and a cathode of the fourth diode is employed for outputting the voltage.

19 Claims, 2 Drawing Sheets

DRIVING CIRCUIT AND LIQUID CRYSTAL DISPLAY DEVICE

CROSS REFERENCE

This application claims the priority of Chinese Patent Application No. 201510570239.7, entitled "Driving circuit and liquid crystal display device", filed on Sep. 9, 2015, the disclosure of which is incorporated herein by reference in its entirety.

FIELD OF THE INVENTION

The present invention relates to a liquid crystal display field, and more particularly to a driving circuit and a liquid crystal display device.

BACKGROUND OF THE INVENTION

As shown in FIG. 1. The prior art provides a driving circuit, comprising a first diode D1, a second diode D2, a third diode D3, a fourth diode D4, a first capacitor C1, a second capacitor C2, a third capacitor C3, a fourth capacitor C4 and an input voltage source V1. An anode of the first diode D1 is employed for inputting a voltage VAA, and a cathode of the first diode D1 is coupled to an anode of the second diode D2, and a cathode of the second diode D2 is coupled to an anode of the third diode D3, and a cathode of the third diode D3 is coupled to an anode of the fourth diode D4, and a cathode of the fourth diode D4 is employed for outputting the voltage VGH, and the first end of the first capacitor C1 is coupled to a common end of the first diode D1 and the second diode D2, and the second end of the first capacitor C1 is coupled to a first end of the input voltage source V1, and a second end of the input voltage source V1 is grounded, and a first end of the second capacitor C2 is coupled to a common end of the second diode D2 and the third diode D3, and the other end of the second capacitor C2 is grounded, and a first end of the third capacitor C3 is coupled to a common end of third diode D3 and the fourth diode D4, and a second end of the third capacitor C3 is coupled to the first end of the input voltage source V1, and a first end of the fourth capacitor C4 is coupled to a cathode of the fourth diode D4, and a second end of the fourth capacitor C4 is grounded. In ideal condition, the relationship between the input voltage VAA and the output voltage VGH is: VGH=VAA+2*V1.

In practical application, for convenience, one output line of the power supply management chip PWM IC is employed to be the input voltage VAA, and the driving signal LX1 in the BOOST line generating the VAA voltage in the power supply management chip is the input voltage source, and is coupled to a resistor in series for obtaining the driving circuit shown in FIG. 2. Then, the relationship between the input voltage VAA and the output voltage VGH is: VGH=VAA+2*LX1.

However, in such arrangement, if the loading of the input voltage VAA is lower or the change of the loading is larger, the power supply management chip PWM IC will enter the DCM mode. The DCM mode is the Discontinuous Conduction mode. In the DCM mode, the ripple wave of the driving signal LX1 is very large and results in that the ripple wave of the output voltage VGH is very large, too.

SUMMARY OF THE INVENTION

The technical issue that the embodiment of the present invention solves is to provide a driving circuit and a liquid crystal display device capable of reducing the ripple wave of the output voltage.

The present invention provides a driving circuit, comprising a first diode, a second diode, a third diode, a fourth diode, a first capacitor, a second capacitor, a third capacitor, a fourth capacitor, a voltage stabilizing triode, a first resistor, a second resistor and a third resistor, and all the first capacitor, the second capacitor, the third capacitor and the fourth capacitor are non adjustable capacitors; an anode of the first diode is employed for inputting a voltage, and an emitter of the voltage stabilizing triode is coupled to a cathode of the second diode, and a collector of the voltage stabilizing triode is coupled to an anode of the third diode, and a cathode of the third diode is coupled to an anode of the fourth diode, and a cathode of the fourth diode is employed for outputting the voltage, and a first end of the first capacitor is coupled to a common end of the first diode and the second diode, and a second end of the first capacitor is coupled to one end of the first resistor, and the other end of the first resistor is employed for inputting a first driving signal, and one end of the second capacitor is coupled to a common end of the second diode and the third diode, and the other end of the second capacitor is grounded, and a base of the voltage stabilizing triode is employed for inputting a voltage stabilizing signal generated by a power supply management chip, and one end of the third capacitor is coupled to a common electrode of the second diode and the emitter of the voltage stabilizing triode, and the other end of the third resistor is coupled to the base of the voltage stabilizing triode, and one end of the third capacitor is coupled to a common end of the third diode and the fourth diode, and the other end of the third capacitor is coupled to one end of the second resistor, and the other end of the second resistor is employed for inputting a second driving signal, and one end of the fourth capacitor is coupled to a cathode of the fourth diode, and the other end of the fourth capacitor is grounded, and the first driving signal is a simulation voltage outputted by the power supply management chip, and the second driving signal is a digital voltage outputted by the power supply management chip.

Selectively, the voltage stabilizing triode is a PNP type triode.

Selectively, the first driving signal is a BOOST voltage in the power supply management chip.

Selectively, the first driving signal is a Buck line voltage of 3.3 volts in the power supply management chip.

Selectively, the first driving signal is a Buck line voltage of 1.2 volts in the power supply management chip.

The present invention further provides a driving circuit, comprising a first diode, a second diode, a third diode, a fourth diode, a first capacitor, a second capacitor, a third capacitor, a fourth capacitor, a first resistor and a second resistor, and an anode of the first diode is employed for inputting a voltage, and a cathode of the first diode is coupled to a cathode of the second diode, and cathode of the second diode is coupled to an anode of the third diode, and a cathode of the third diode is coupled to an anode of the fourth diode, and a cathode of the fourth diode is employed for outputting the voltage, and a first end of the first capacitor is coupled to a common end of the first diode and the second diode, and a second end of the first capacitor is coupled to one end of the first resistor, and the other end of the first resistor is employed for inputting a first driving signal, and one end of the second capacitor is coupled to a common end of the second diode and the third diode, and the other end of the second capacitor is grounded, and one end of the third capacitor is coupled to a common end of the third diode and the fourth diode, and the other end of the third capacitor is coupled to one end of the second resistor, and the other end of the second resistor is employed for inputting a second driving signal, and one end of the fourth capacitor is coupled to a cathode of the fourth diode, and the other end of the fourth capacitor is grounded, and the first driving signal is a simulation voltage outputted by the power supply management chip, and the second driving signal is a digital voltage outputted by the power supply management chip.

Selectively, the driving circuit further comprises a voltage stabilizing triode and a third resistor, and an emitter of the voltage stabilizing triode is coupled to a cathode of the second diode, and a collector of the voltage stabilizing triode is coupled to an anode of the third diode, and a base of the voltage stabilizing triode is employed for inputting a voltage stabilizing signal generated by a power supply management chip, and one end of the third resistor is coupled to a common electrode of the second diode and the emitter of the voltage stabilizing triode, and the other end of the third resistor is coupled to a base of the voltage stabilizing triode.

Selectively, the voltage stabilizing triode is a PNP type triode.

Selectively, the first driving signal is a BOOST voltage in the power supply management chip.

Selectively, the first driving signal is a Buck line voltage of 3.3 volts in the power supply management chip.

Selectively, the first driving signal is a Buck line voltage of 1.2 volts in the power supply management chip.

Selectively, all the first capacitor, the second capacitor, the third capacitor and the fourth capacitor are non adjustable capacitors.

The present invention further provides a liquid crystal display panel, wherein the liquid crystal display panel comprises a driving circuit, comprising a first diode, a second diode, a third diode, a fourth diode, a first capacitor, a second capacitor, a third capacitor, a fourth capacitor, a first resistor and a second resistor, and an anode of the first diode is employed for inputting a voltage, and a cathode of the first diode is coupled to a cathode of the second diode, and cathode of the second diode is coupled to an anode of the third diode, and a cathode of the third diode is coupled to an anode of the fourth diode, and a cathode of the fourth diode is employed for outputting the voltage, and a first end of the first capacitor is coupled to a common end of the first diode and the second diode, and a second end of the first capacitor is coupled to one end of the first resistor, and the other end of the first resistor is employed for inputting a first driving signal, and one end of the second capacitor is coupled to a common end of the second diode and the third diode, and the other end of the second capacitor is grounded, and one end of the third capacitor is coupled to a common end of the third diode and the fourth diode, and the other end of the third capacitor is coupled to one end of the second resistor, and the other end of the second resistor is employed for inputting a second driving signal, and one end of the fourth capacitor is coupled to a cathode of the fourth diode, and the other end of the fourth capacitor is grounded, and the first driving signal is a simulation voltage outputted by the power supply management chip, and the second driving signal is a digital voltage outputted by the power supply management chip.

Selectively, the driving circuit further comprises a voltage stabilizing triode and a third resistor, and an emitter of the voltage stabilizing triode is coupled to a cathode of the second diode, and a collector of the voltage stabilizing triode is coupled to an anode of the third diode, and a base of the voltage stabilizing triode is employed for inputting a voltage stabilizing signal generated by a power supply management chip, and one end of the third resistor is coupled to a common electrode of the second diode and the emitter of the voltage stabilizing triode, and the other end of the third resistor is coupled to a base of the voltage stabilizing triode.

Selectively, the voltage stabilizing triode is a PNP type triode.

Selectively, the first driving signal is a BOOST voltage in the power supply management chip.

Selectively, the first driving signal is a Buck line voltage of 3.3 volts in the power supply management chip.

Selectively, the first driving signal is a Buck line voltage of 1.2 volts in the power supply management chip.

Selectively, all the first capacitor, the second capacitor, the third capacitor and the fourth capacitor are non adjustable capacitors.

With the embodiment of the present invention, two driving signal can be respectively inputted between the first diode and the second diode and between the third diode and the fourth diode, wherein the first driving signal is a simulation voltage outputted by the power supply management chip, and the second driving signal is a digital voltage outputted by the power supply management chip. The driving ability of the first driving signal is large and can remedy the insufficient driving ability of the second driving signal. The current stability of the second driving signal is high and normally it will not enter a DCM mode. Beside, the probability that the first driving signal and the second driving signal enter the DCM mode at the same time is extremely low, which can remedy the property of large ripple wave of the first driving signal for reducing the ripple wave of the output voltage.

BRIEF DESCRIPTION OF THE DRAWINGS

In order to more clearly illustrate the embodiments of the present invention or prior art, the following figures will be described in the embodiments are briefly introduced. It is obvious that the drawings are merely some embodiments of the present invention, those of ordinary skill in this field can obtain other figures according to these figures without paying the premise.

DETAILED DESCRIPTION OF PREFERRED EMBODIMENTS

Embodiments of the present invention are described in detail with the technical matters, structural features, achieved objects, and effects with reference to the accompanying drawings as follows. It is clear that the described embodiments are part of embodiments of the present invention, but not all embodiments. Based on the embodiments of the present invention, all other embodiments to those of ordinary skill in the premise of no creative efforts obtained, should be considered within the scope of protection of the present invention.

Specifically, the terminologies in the embodiments of the present invention are some features and advantages of the invention are merely for describing the purpose of the certain embodiment, but not to limit the invention. Examples and the appended claims be implemented in the present invention requires the use of the singular form of the book "an", "the" and "the" are intended to include most forms unless the context clearly dictates otherwise. It should also be understood that the terminology used herein that "and/or" means and includes any or all possible combinations of one or more of the associated listed items.

Figure 1:
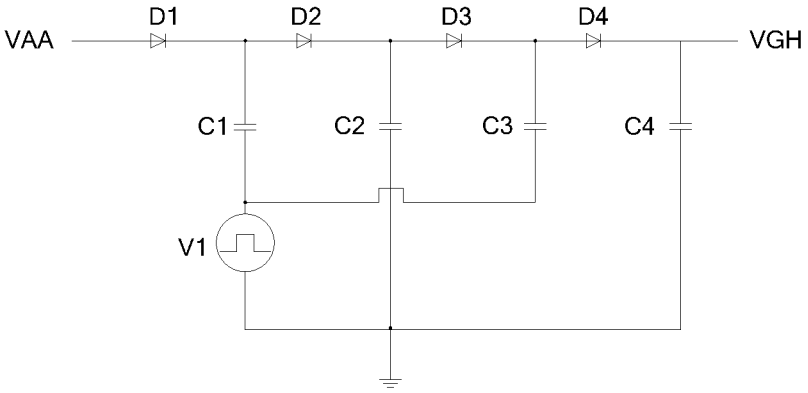
FIG. 1 is a circuit diagram of one embodiment according to a driving circuit of the present invention.
Figure 2:
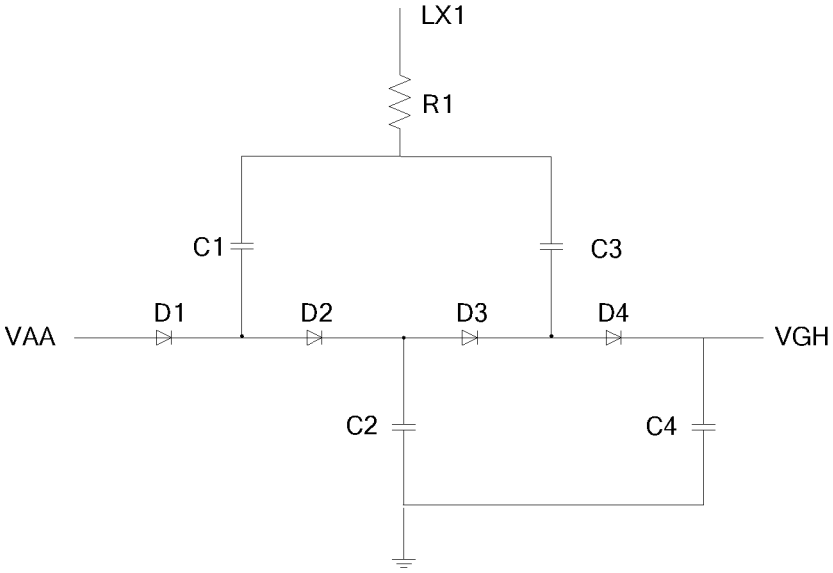
FIG. 2 is a circuit diagram of another embodiment according to a driving circuit of the present invention.
Figure 3:
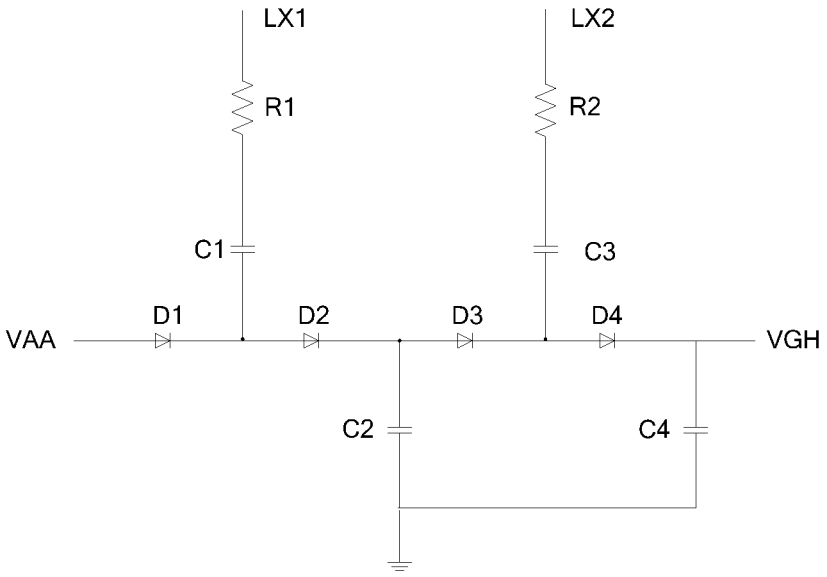
FIG. 3 is a circuit diagram of one driving circuit according to the embodiment of the present invention.

Please refer to FIG. 3. FIG. 3 is a circuit diagram of one driving circuit according to the embodiment of the present invention. The driving circuit of this embodiment comprises: a first diode D1, a second diode D2, a third diode D3, a fourth diode D4, a first capacitor C1, a second capacitor C2, a third capacitor C3, a fourth capacitor C4, a first resistor R1 and a second resistor R2.

An anode of the first diode D1 is employed for inputting a voltage, and a cathode of the first diode D1 is coupled to an anode of the second diode D2, and a cathode of the second diode D2 is coupled to an anode of the third diode D3, and a cathode of the third diode D3 is coupled to an anode of the fourth diode D4, and a cathode of the fourth diode D4 is employed for outputting the voltage.

The first end of the first capacitor C1 is coupled to a common end of the first diode D1 and the second diode D2, and the second end of the first capacitor C1 is coupled to one end of the first resistor R1, and the other end of the resistor R1 is employed for inputting a first driving signal, and one end of the second capacitor C2 is coupled to a common end of the second diode D2 and the third diode D3, and the other end of the second capacitor C2 is grounded, and one end of the third capacitor C3 is coupled to a common end of the third diode D3 and the fourth diode D4, and the other end of the third capacitor C3 is coupled to one end of the second resistor R2, and the other end of the second resistor R2 is employed for inputting a second driving signal, and one end of the fourth capacitor C4 is coupled to the cathode of the fourth diode D4, and the other end of the fourth capacitor C4 is grounded.

At the first stage, the first driving signal and the second driving signal are low voltage levels, and then all the first diode D1, the second diode D2, the third diode D3 and the fourth diode D4 are activated, and the output voltages VD1, VD2, VD3, VD4 of the first diode D1, the second diode D2, the third diode D3 and the fourth diode D4 are all VAA.

At the second stage, the first driving signal and the second driving signal are high voltage levels, and the first diode D1 is deactivated, and all the second diode D2, the third diode D3 and the fourth diode D4 are activated, and the output voltages VD1, VD2, VD3, VD4 of the first diode D1, the second diode D2, the third diode D3 and the fourth diode D4 are all LX1+LX2+VAA.

At the third stage, the first driving signal and the second driving signal are low voltage levels, and then the first diode D1 and the third diode D3 are activated, and the second diode D2 and the fourth diode D4 are deactivated, and the output voltage VD1 of the first diode D1 is VAA, and the output voltages VD2, VD3, VD4 of the second diode D2, the third diode D3 and the fourth diode D4 are all LX1+LX2+VAA.

At the fourth stage, the first driving signal and the second driving signal are high voltage levels, and then the first diode D1 and the third diode D3 are deactivated, and the second diode D2 and the fourth diode D4 are activated, and the output voltage VD1 of the first diode D1 is LX1+LX2+VAA, and the output voltage VD2 of the second diode D2 is LX1+LX2+VAA, and the output voltages VD3, VD4 of the third diode D3 and the fourth diode D4 are both 2(LX1+LX2)+VAA.

It is understandable that for better understanding in this embodiment, the first driving signal and the second driving signal are at the high voltage level or at the low voltage level at the same time. However, in practical procedure, as long as the first driving signal and the second driving signal respectively change in order of low voltage level-high voltage level-low voltage level-high voltage level, the result of 2(LX1+LX2)+VAA can be obtained.

The first driving signal is a simulation voltage outputted by the power supply management chip, and the second driving signal is a digital voltage outputted by the power supply management chip. The driving ability of the first driving signal is strong. The peak value of the first driving signal is far greater than the peak value of the second driving signal, which can remedy the insufficient driving ability of the second driving signal. The probability that the first driving signal and the second driving signal enter the DCM mode at the same time is extremely small. Thus, if the first driving signal enters the DCM mode, the second driving signal can normally provide power, and if the second driving signal enters the DCM mode, the first driving signal can normally provide power for reducing the ripple wave of the output voltage. Besides, the stability of the second driving signal is high, and normally it will not enter a DCM mode, which can effectively reduce the ripple wave of the output voltage.

Figure 4:
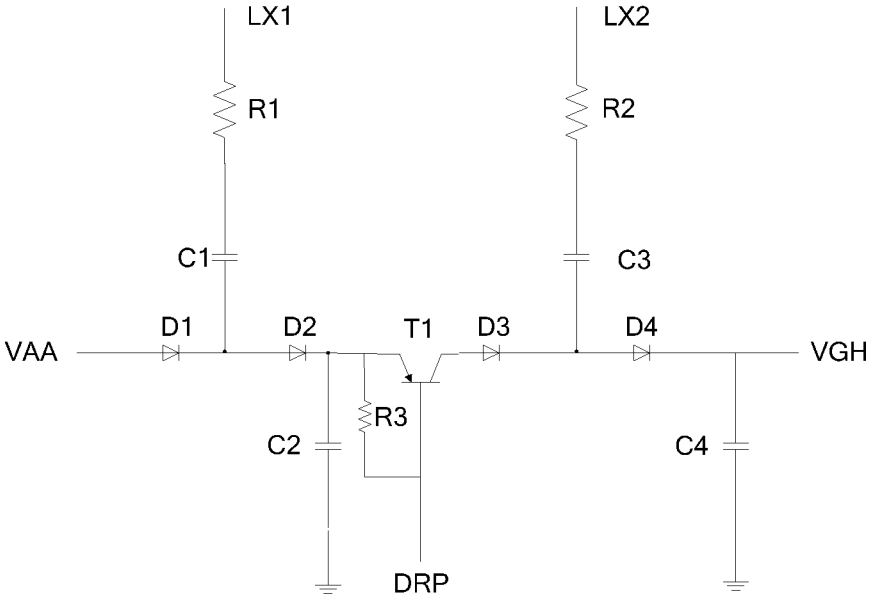
FIG. 4 is a circuit diagram of another driving circuit according to the embodiment of the present invention.

Please refer to FIG. 4. FIG. 4 is a circuit diagram of another driving circuit according to the embodiment of the present invention. The driving circuit of this embodiment comprises: a first diode D1, a second diode D2, a third diode D3, a fourth diode D4, a first capacitor C1, a second capacitor C2, a third capacitor C3, a fourth capacitor C4, a first resistor R1, a second resistor R2, a third resistor R3 and a voltage stabilizing triode T1. All the first capacitor C1, the second capacitor C2, the third capacitor C3 and the fourth capacitor C4 are non adjustable capacitors. The voltage stabilizing triode T1 is a PNP type triode.

An anode of a first diode D1 is employed for inputting a voltage, and a cathode of the first diode D1 is coupled to an anode of the second diode D2, and a cathode of the second diode D2 is coupled to an emitter of the voltage stabilizing triode T1, and a collector of the voltage stabilizing triode T1 is coupled to an anode of the third diode D3, and a cathode of the third diode D3 is coupled to an anode of a fourth diode D4, and a cathode of the fourth diode D4 is employed for outputting the voltage, and a first end of the first capacitor C1 is coupled to a common end of the first diode D1 and the second diode D2, and a second end of the first capacitor C1 is coupled to one end of the first resistor R1, and the other end of the first resistor R1 is employed for inputting a first driving signal, and one end of the second capacitor C2 is coupled to a common end of the second diode D2 and the third diode D3, and the other end of the second capacitor C2 is grounded, and one end of the third capacitor R3 is coupled to a common end of the third diode D3 and the voltage stabilizing triode T1, and the other end of the third capacitor R3 is coupled to a base of the voltage stabilizing triode T1, and the base of the voltage stabilizing triode T1 is employed for inputting a voltage stabilizing signal DRP generated by a power supply management chip, and the voltage stabilizing triode T1 can stably outputs the voltage to reduce the generation of the ripple wave. One end of the third capacitor C3 is coupled to a common end of the third diode D3 and the fourth diode D4, and the other end of the third capacitor C3 is coupled to one end of the second resistor R2, and the other end of the second resistor R2 is employed for inputting a second driving signal, and one end of the fourth capacitor C4 is coupled to a cathode of the fourth diode D4, and the other end of the fourth capacitor C4 is grounded.

At the first stage, the first driving signal and the second driving signal are low voltage levels, and then all the first diode D1, the second diode D2, the third diode D3 and the fourth diode D4 are activated, and the output voltages VD1, VD2, VD3, VD4 of the first diode D1, the second diode D2, the third diode D3 and the fourth diode D4 are all VAA.

At the second stage, the first driving signal and the second driving signal are high voltage levels, and the first diode D1 is deactivated, and all the second diode D2, the third diode D3 and the fourth diode D4 are activated, and the output voltages VD1, VD2, VD3, VD4 of the first diode D1, the second diode D2, the third diode D3 and the fourth diode D4 are all LX1+LX2+VAA.

At the third stage, the first driving signal and the second driving signal are low voltage levels, and then the first diode D1 and the third diode D3 are activated, and the second diode D2 and the fourth diode D4 are deactivated, and the output voltage VD1 of the first diode D1 is VAA, and the output voltages VD2, VD3, VD4 of the second diode D2, the third diode D3 and the fourth diode D4 are all LX1+LX2+VAA.

At the fourth stage, the first driving signal and the second driving signal are high voltage levels, and then the first diode D1 and the third diode D3 are deactivated, and the second diode D2 and the fourth diode D4 are activated, and the output voltage VD1 of the first diode D1 is LX1+LX2+VAA, and the output voltage VD2 of the second diode D2 is LX1+LX2+VAA, and the output voltages VD3, VD4 of the third diode D3 and the fourth diode D4 are both 2(LX1+LX2)+VAA.

It is understandable that for better understanding in this embodiment, the first driving signal and the second driving signal are at the high voltage level or at the low voltage level at the same time. However, in practical procedure, as long as the first driving signal and the second driving signal respectively change in order of low voltage level-high voltage level-low voltage level-high voltage level, the result of 2(LX1+LX2)+VAA can be obtained.

The first driving signal is a simulation voltage outputted by the power supply management chip, and the second driving signal is a digital voltage outputted by the power supply management chip. In one embodiment, the first driving signal is a BOOST voltage in the power supply management chip, a Buck line voltage of 3.3 volts in the power supply management chip or a Buck line voltage of 1.2 volts in the power supply management chip. The driving ability of the first driving signal is strong. The peak value of the first driving signal is far greater than the peak value of the second driving signal, which can remedy the insufficient driving ability of the second driving signal. The probability that the first driving signal and the second driving signal enter the DCM mode at the same time is extremely small. Thus, if the first driving signal enters the DCM mode, the second driving signal can normally provide power, and if the second driving signal enters the DCM mode, the first driving signal can normally provide power for reducing the ripple wave of the output voltage. Besides, the stability of the second driving signal is high, and normally it will not enter a DCM mode, which can effectively reduce the ripple wave of the output voltage.

The present invention further provides a liquid crystal display panel, and the panel comprises the driving circuit shown in FIG. 3 or FIG. 4. The detail specification can be referred to FIG. 3, FIG. 4 and related descriptions. The repeated description is omitted here.

It is understandable in practical to the person who is skilled in the art that all or portion of the processes in the method according to the aforesaid embodiment can be accomplished with the computer program to instruct the related hardwares. The program can be stored in a readable storage medium if the computer. As the program is executed, the processes of the embodiments in the aforesaid respective methods can be included. The storage medium can be a hard disk, an optical disc, a Read-Only Memory (ROM) or a Random Access Memory (RAM).

Above are embodiments of the present invention, which does not limit the scope of the present invention. Any modifications, equivalent replacements or improvements within the spirit and principles of the embodiment described above should be covered by the protected scope of the invention.

What is claimed is:

1. A driving circuit, comprising a first diode, a second diode, a third diode, a fourth diode, a first capacitor, a second capacitor, a third capacitor, a fourth capacitor, a voltage stabilizing triode, a first resistor, a second resistor and a third resistor, and all the first capacitor, the second capacitor, the third capacitor and the fourth capacitor are non adjustable capacitors;

an anode of the first diode is employed for inputting a voltage, and an emitter of the voltage stabilizing triode is coupled to a cathode of the second diode, and a collector of the voltage stabilizing triode is coupled to an anode of the third diode, and a cathode of the third diode is coupled to an anode of the fourth diode, and a cathode of the fourth diode is employed for outputting the voltage, and a first end of the first capacitor is coupled to a common end of the first diode and the second diode, and a second end of the first capacitor is coupled to one end of the first resistor, and the other end of the first resistor is employed for inputting a first driving signal, and one end of the second capacitor is coupled to a common end of the second diode and the third diode, and the other end of the second capacitor is grounded, and a base of the voltage stabilizing triode is employed for inputting a voltage stabilizing signal generated by a power supply management chip, and one end of the third resistor is coupled to a common end of the second diode and the emitter of the voltage stabilizing triode, and the other end of the third resistor is coupled to the base of the voltage stabilizing triode, and one end of the third capacitor is coupled to a common end of the third diode and the fourth diode, and the other end of the third capacitor is coupled to one end of the second resistor, and the other end of the second resistor is employed for inputting a second driving signal, and one end of the fourth capacitor is coupled to a cathode of the fourth diode, and the other end of the fourth capacitor is grounded, and the first driving signal is a simulation voltage outputted by the power supply management chip, and the second driving signal is a digital voltage outputted by the power supply management chip.

2. The circuit according to claim 1, wherein the voltage stabilizing triode is a PNP type triode.

3. The circuit according to claim 1, wherein the first driving signal is a BOOST voltage in the power supply management chip.

4. The circuit according to claim 1, wherein the first driving signal is a Buck line voltage of 3.3 volts in the power supply management chip.

5. The circuit according to claim 1, wherein the first driving signal is a Buck line voltage of 1.2 volts in the power supply management chip.

6. A driving circuit, comprising a first diode, a second diode, a third diode, a fourth diode, a first capacitor, a second capacitor, a third capacitor, a fourth capacitor, a first resistor and a second resistor, and an anode of the first diode is employed for inputting a voltage, and a cathode of the first diode is coupled to an anode of the second diode, and cathode of the second diode is coupled to an anode of the third diode, and a cathode of the third diode is coupled to an anode of the fourth diode, and a cathode of the fourth diode is employed for outputting the voltage, and a first end of the first capacitor is coupled to a common end of the first diode and the second diode, and a second end of the first capacitor is coupled to one end of the first resistor, and the other end of the first resistor is employed for inputting a first driving signal, and one end of the second capacitor is coupled to a common end of the second diode and the third diode, and the other end of the second capacitor is grounded, and one end of the third capacitor is coupled to a common end of the third diode and the fourth diode, and the other end of the third capacitor is coupled to one end of the second resistor, and the other end of the second resistor is employed for inputting a second driving signal, and one end of the fourth capacitor is coupled to a cathode of the fourth diode, and the other end of the fourth capacitor is grounded, and the first driving signal is a simulation voltage outputted by the power supply management chip, and the second driving signal is a digital voltage outputted by the power supply management chip.

7. The circuit according to claim 6, wherein the driving circuit further comprises a voltage stabilizing triode and a third resistor, and an emitter of the voltage stabilizing triode is coupled to a cathode of the second diode, and a collector of the voltage stabilizing triode is coupled to an anode of the third diode, and a base of the voltage stabilizing triode is employed for inputting a voltage stabilizing signal generated by a power supply management chip, and one end of the third resistor is coupled to a common end of the second diode and the emitter of the voltage stabilizing triode, and the other end of the third resistor is coupled to a base of the voltage stabilizing triode.

8. The circuit according to claim 7, wherein the voltage stabilizing triode is a PNP type triode.

9. The circuit according to claim 6, wherein the first driving signal is a BOOST voltage in the power supply management chip.

10. The circuit according to claim 6, wherein the first driving signal is a Buck line voltage of 3.3 volts in the power supply management chip.

11. The circuit according to claim 6, wherein the first driving signal is a Buck line voltage of 1.2 volts in the power supply management chip.

12. The circuit according to claim 6, wherein all the first capacitor, the second capacitor, the third capacitor and the fourth capacitor are non adjustable capacitors.

13. A liquid crystal display panel, wherein the liquid crystal display panel comprises a driving circuit, comprising a first diode, a second diode, a third diode, a fourth diode, a first capacitor, a second capacitor, a third capacitor, a fourth capacitor, a first resistor and a second resistor, an anode of the first diode is employed for inputting a voltage, and a cathode of the first diode is coupled to an anode of the second diode, and cathode of the second diode is coupled to an anode of the third diode, and a cathode of the third diode is coupled to an anode of the fourth diode, and a cathode of the fourth diode is employed for outputting the voltage, and a first end of the first capacitor is coupled to a common end of the first diode and the second diode, and a second end of the first capacitor is coupled to one end of the first resistor, and the other end of the first resistor is employed for inputting a first driving signal, and one end of the second capacitor is coupled to a common end of the second diode and the third diode, and the other end of the second capacitor is grounded, and one end of the third capacitor is coupled to a common end of the third diode and the fourth diode, and the other end of the third capacitor is coupled to one end of the second resistor, and the other end of the second resistor is employed for inputting a second driving signal, and one end of the fourth capacitor is coupled to a cathode of the fourth diode, and the other end of the fourth capacitor is grounded, and the first driving signal is a simulation voltage outputted by the power supply management chip, and the second driving signal is a digital voltage outputted by the power supply management chip.

14. The liquid crystal display panel according to claim 13, wherein the driving circuit further comprises a voltage stabilizing triode and a third resistor, and an emitter of the voltage stabilizing triode is coupled to a cathode of the second diode, and a collector of the voltage stabilizing triode is coupled to an anode of the third diode, and a base of the voltage stabilizing triode is employed for inputting a voltage stabilizing signal generated by a power supply management chip, and one end of the third resistor is coupled to a common end of the second diode and the emitter of the voltage stabilizing triode, and the other end of the third resistor is coupled to a base of the voltage stabilizing triode.

15. The liquid crystal display panel according to claim 14, wherein the voltage stabilizing triode is a PNP type triode.

16. The liquid crystal display panel according to claim 13, wherein the first driving signal is a BOOST voltage in the power supply management chip.

17. The liquid crystal display panel according to claim 13, wherein the first driving signal is a Buck line voltage of 3.3 volts in the power supply management chip.

18. The liquid crystal display panel according to claim 13, wherein the first driving signal is a Buck line voltage of 1.2 volts in the power supply management chip.

19. The liquid crystal display panel according to claim 13, wherein all the first capacitor, the second capacitor, the third capacitor and the fourth capacitor are non adjustable capacitors.

* * * * *